United States Patent [19]

Pulciani et al.

[11] Patent Number: 4,768,672

[45] Date of Patent: Sep. 6, 1988

[54] CONTAINER PROFILE WITH STACKING FEATURE

[75] Inventors: Sam C. Pulciani, Norridge; Robert M. Szczerba, Algonquin, both of Ill.

[73] Assignee: American National Can Company, Chicago, Ill.

[21] Appl. No.: 50,570

[22] Filed: Jun. 25, 1987

Related U.S. Application Data

[63] Continuation of Ser. No. 736,428, May 20, 1985, Pat. No. 4,685,582.

[51] Int. Cl.[4] ..... B65D 6/02; B65D 21/02

[52] U.S. Cl. ..... 220/66; 206/508; 206/509; 220/70; 220/DIG. 22

[58] Field of Search ..... 206/508, 509; 220/66, 220/70, DIG. 22

[56] References Cited

U.S. PATENT DOCUMENTS

| | | | |
|---|---|---|---|
| 3,189,214 | 6/1965 | Henchert | 206/508 |
| 3,279,640 | 10/1966 | Dodson | 220/70 |
| 3,288,342 | 11/1966 | Tinker | 206/508 |
| 3,349,956 | 10/1967 | Stephan | 206/508 |
| 3,973,693 | 8/1976 | Brocklehurst | 220/70 |
| 4,151,927 | 5/1979 | Cuacho | 220/70 |
| 4,341,321 | 7/1982 | Gombas | 220/70 |
| 4,412,627 | 11/1983 | Houghton | 220/66 |

FOREIGN PATENT DOCUMENTS

| | | | |
|---|---|---|---|
| 2398669 | 3/1979 | France | 220/70 |

*Primary Examiner*—George E. Lowrance

*Attorney, Agent, or Firm*—Robert A. Stenzel; Ralph R. Rath

[57] ABSTRACT

A drawn and ironed container having a reduced neck around an upper open end has a bottom profile which exhibits excellent strength characteristics and nests with an end double-seamed to the open end of the container. The bottom profile includes a center spherical dome surrounded by a U-shaped annular portion defining a lower support surface for the container. A joining segment is integral with the container side wall and the U-shaped annular portion includes a first annular arcuate portion having an exterior radius and a second annular arcuate portion having an interior radius.

6 Claims, 2 Drawing Sheets

CONTAINER PROFILE WITH STACKING FEATURE

REFERENCE TO RELATED APPLICATION

This application is a continuation application of U.S. Ser. No. 736,428, filed May 20, 1985 U.S. Pat. No. 4,085,582.

DESCRIPTION

TECHNICAL FIELD

The present invention relates generally to drawn and ironed two-piece containers having an end seamed to the open end of the container to form a package and, more particularly, to a bottom profile for the drawn and ironed container that is capable of withstanding the minimum pressure and crush strength requirements and, at the same time, is capable of nesting with ends attached to the opposite ends of the containers.

2. Background Prior Art

Numerous container constructions have been developed in the past decade for the conventional drawn and ironed container that is used in the packaging of beer and beverage products. Conventionally, the drawn and ironed container is formed from a circular disc of stock material which is converted into a cup and then transformed into a finished container having a particular bottom profile and a reduced thickness cylindrical side wall, along with a reduced neck around the open end of the container which incorporates a flange that is seamed to the container end to form the finished package.

In the past few years, the manufacturers of drawn and ironed containers of this type have directed considerable effort towards a container bottom wall or profile of the two-piece container so that thinner stock material can be used, while the container is still capable of resisting the necessary internal pressures and column strengths that are required for a package of this type. An example of a container that has found a remarkable degree of commercial success is the container disclosed in U.S. Ser. No. 426,888, filed Sept. 29, 1982, by the Assignee of the present invention, and incorporated herein by reference.

More specifically, the container bottom profile disclosed in this application has allowed for substantial reduction in the metal thickness of the stock material to reduce the overall cost of the container and, at the same time, still maintain the pressure, buckle and column strength that are necessary for a container of this type.

In the past decade, a drawn and ironed container of this type has been formed with a reduced neck at the upper open end so that the seam utilized for connecting the end to the container is located within the peripheral boundaries of the side wall to improve the handling and stacking. More recently, this type of container has incorporated a reduced neck of the type that is referred to in the industry as "a double-neck" or "triple-neck", wherein the side wall of the container is reduced in stages so that the end can be of smaller diameter to further reduce the material requirements for such a container. Even more recently, the double- and triple-necking operation for reducing the neck of the open end of the container has been replaced with a spin-forming operation, and a container incorporating such a reduced neck is disclosed in U.S. Pat. No. DES 275,834, owned by Metal Box Limited, Reading, England.

Another type of container that has been proposed is disclosed in U.S. Pat. Nos. 3,904,069 and 3,979,009, along with U.S. Pat. No. 4,412,627. The containers disclosed in these patents have a bottom wall construction which is designed to permit selected and controlled outward flexing or bulging of the bottom wall when the container is sealed and subjected to internal pressures developed by the contents. One of the disadvantages of this type of container is the fact that after it has been sealed and the pressure of the contents increases, the overall height or length of the container increases (commonly referred to as "container growth"), which makes it more difficult to handle in subsequent operations. Also, during such container growth, the support portion of the container may increase or decrease in diameter and, thereby making the container rather unstable while it is being displayed for sale.

Various other types of bottom profile configurations have been proposed and are disclosed in the various references and prior art cited in the above-mentioned application.

One problem that has recently received some attention is the handling of the containers, particularly during shipment, storage and display. With the increased use of the reduced end necked portion on the upper end of the container, allowing for the use of smaller ends as part of the package, one of the problems that has been encountered is stability of the containers, particularly when several six-packs of individual containers are stacked upon each other. This has created a problem in displaying the goods on shelves. While this has to some degree been a problem in the industry, no particular attention has been given to solutions for accommodating proper stacking and interlocking of a plurality of containers on a shelf.

SUMMARY OF THE INVENTION

According to the present invention, a container having a cylindrical side wall and a profiled bottom wall, along with a reduced neck, is formed using reduced thickness stock material without increasing the diameter of the disc-shaped stock material. The new container has excellent column strength, buckle strength and resistance to harsh handling, while at the same time incorporates a nesting feature for allowing the bottom profile wall to nest with the end attached to the reduced neck portion of the container.

More specifically, a drawn and ironed beer and beverage container includes a cylindrical side wall having a reduced neck surrounding an upper open end with an outwardly-directed flange adapted to be seamed to a reduced diameter end. The bottom profile is designed to nest on the reduced diameter end to provide a peripheral support around the entire perimeter between the end and the bottom of two adjacent containers.

The bottom profile includes a spherically, inwardly-domed portion surrounded by a generally U-shaped annular segment defining a lower support for the container with the annular segment having a diameter of about 80% of the diameter of the side wall. A specifically configured annular joining segment is integral with the side wall and the U-shaped annular segment with the joining segment including a first annular arcuate portion having an interior radius and a second annular arcuate portion having an exterior radius to produce an annular support point for nesting with an end on an adjacent container.

The particular domed profile is configured to eliminate the need of any metal reversal during the formation of the bottom profile at the end of a drawing and ironing operation, and the profile incorporates specifically-dimensioned radii and segments that simplify the metal-deforming process so that the containers can be manufactured at acceptable production rates.

In the specific embodiment illustrated in the drawings, the interior radius of the first annular arcuate segment is approximately one-tenth of the diameter of the lower support annular surface for the container and the exterior radius of the second annular arcuate segment is approximately one-half of the radius of the first annular arcuate segment, while the diameter of the lower support portion is substantially less than the peripheral diameter of the cylindrical side wall and is also less than the radius of the spherical portion to produce a container having sufficient strength characteristics that can be manufactured from stock material having a thickness of 0.0128 inch or less and still meet all of the minimum requirements for such a container.

BRIEF DESCRIPTION OF SEVERAL VIEWS OF DRAWINGS

DETAILED DESCRIPTION

Figure 1:
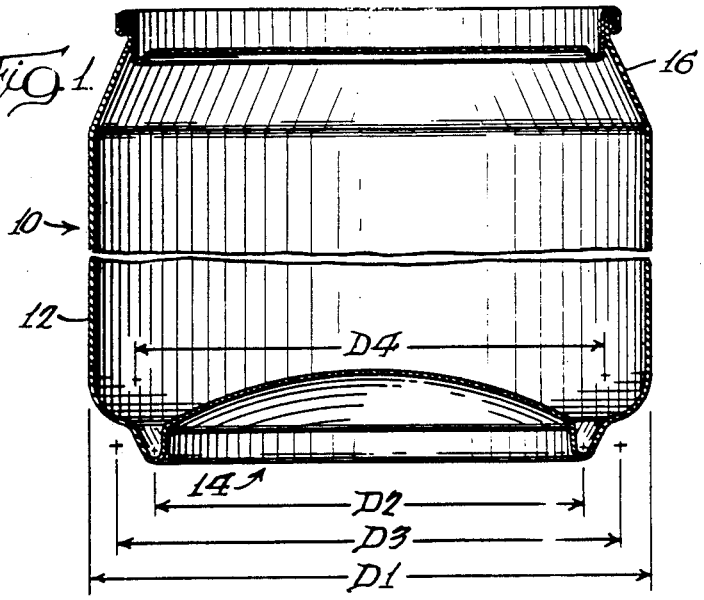
FIG. 1 is a fragmentary cross-sectional view of the container constructed in accordance with the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings discloses a fragmentary portion of a container, generally designated by reference numeral 10, having a generally cylindrical side wall 12 and an integral end wall 14. Container 10 is what is commonly known as a "drawn and ironed container" wherein a flat circular metal disc is converted into a shallow cup in a press, commonly referred to as a "cupper". The shallow cup is then delivered to a drawing and ironing machine, commonly referred to as a "bodymaker" wherein the cup is reformed to reduce the diameter thereof and increase the height by reducing the thickness of the side wall. The end wall is subsequently reformed at the end of the stroke of the punch that forms part of the press or bodymaker. After the end wall or bottom has been reformed to the particular bottom profile, the container has a reduced neck 16 formed around the open end and an outwardly-directed flange 18 with the flange being utilized for double-seaming an end thereto.

With the increased attention in reduction of metal costs, many manufacturers are now utilizing what is referred in the industry as a "206 End" rather than the prior, most common "209 End", the numerical values indicating the effective diameter of the end, which also dictates the amount of metal required for forming the end. With the use of the "206 End" and a substantially reduced neck on the upper end of the container, the problem of stacking several groups of containers upon each other has become more acute. Most commercially-available containers use a bottom profile having an outwardly-convex peripheral annular segment surrounding a reduced diameter lower support surface and an inwardly-domed central portion inside the annular support surface.

According to the present invention, the bottom profile of the drawn and ironed container is configured such that the bottom of one container will nest within the end of an adjacent container end attached to the reduced neck and the container is still capable of withstanding internal pressures on the order of 100 psi and also has a column strength of approximately 350 pounds or greater. Moreover, the present container has exhibited excellent results in drop-tests that have recently become a criteria in the beer and beverage industry.

According to the present invention, the lower end 14 of the container 10 includes a center domed portion 20 surrounded by an annular U-shaped portion 22 and an annular joining segment 24 integral with the side wall 12 and the U-shaped portion 22.

Figure 3:
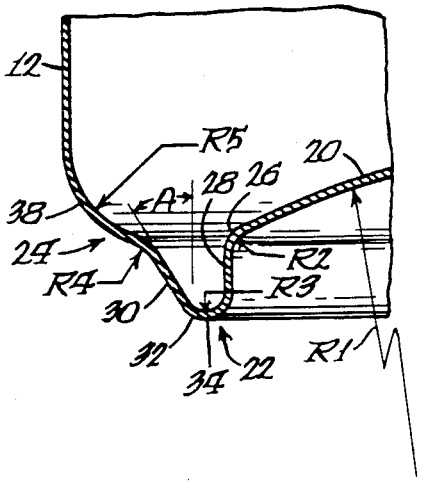
FIG. 3 is an enlarged fragmentary segment of the container bottom profile.

As shown in FIG. 3, the center domed portion 20 has a spherical radius R1 and is joined to the U-shaped portion by an arcuate segment 26 having a radius R2. The U-shaped portion 22 includes an annular, substantially vertical wall 28 and an outer annular wall 30 interconnected by an annular arcuate lower segment 32 having an interior radius R3. The lower segment 32 defines an annular support surface 34 for the container 10. The inner annular wall 28 is substantially vertical and defines an included angle with respect to a vertical axis (not shown) through the container which is as close to zero as possible, while the outer annular wall 30 defines an angle A.

The joining segment 24 includes a first annular arcuate portion 36 having an exterior radius R4 and a second annular arcuate portion 38 having an interior radius R5.

The particular radii and dimensions of the various parts that form the integral lower end 14 of the container are important to the overall performance of the container when filled with pressurized contents and also incorporates a nesting feature which will preclude "wobbling" when two filled containers are stacked on each other.

A specific set of parameters will now be described with the understanding that some of these parameters may be varied without departing from the spirit of the present invention.

A container having a cylindrical side wall diameter D1 of 2.597 inches (64.93 mm) was formed from a flat circular disc having a diameter of 5.495 inches (137.38 mm) and a thickness of 0.0128 inch (.32 mm). The disc was first converted into a cup and then converted to a finished drawn and ironed container using tooling shown in FIG. 2, to be described later.

The container center dome 20 has a spherical radius R1 of 2.120 inches (53.85 mm) with the radius R2 of segment 26 being 0.050 inch (1.25 mm).

The lower annular arcuate support had a radius R3 of 0.040 inch (1.00 mm) and the angle A for wall segment 30 was 27° 30′ and the angle for wall segment 28 was less than 5°, preferably as close to vertical as possible. The exterior radius R4 was 0.100 inch (2.80 mm), while the interior radius R5 was 0.200 inch (5.00 mm).

The support diameter D2 for the container was 2.000 inches (50.00 mm), while the diameter D3 for the center of the radius R4 was 2.365 inches (59.13 mm) and the diameter D4 for the center of the radius R5 as 2.187 inches (54.68 mm).

Figure 4:
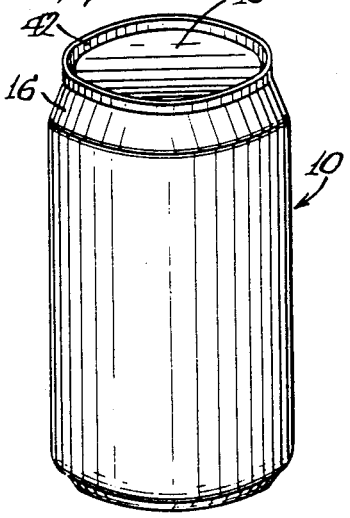
FIG. 4 is a perspective view of a container having an end seamed thereto; and, FIG. 5 is a fragmentary cross-sectional view showing two containers in nesting relation to each other.

This type of container was then filled with beverage and an end 40 was seamed to the reduced neck portion 16 by a double seam 42 (FIG. 4). The end was a standard commercial 206 End. It should be noted in FIG. 1, the double seam 42 has an inner flat, substantially vertical wall 43 that extends parallel to the axis of the container and has a diameter D. The diameter D is less than the diameter D1 of the side wall and greater than the diameter D2 of the lower support surface. Also, the upper end 44 is substantially arcuate and defines an arcuate surface on the upper end of the vertical wall 43.

This container was tested extensively and was found to meet or exceed all minimum requirements for the beer and beverage industry. Furthermore, filled containers, when stacked upon each other, had a good snug fit with continuous contact around the entire periphery.

Actual tests were conducted on this container and it was found that the bottom profile nested snuggly into a "206 End" double seamed to the opposite end of the container after it was filled with a product and did not "rock". Dome reversal tests were then conducted using a bottom profile having a dome height of 0.390 inch, measured from the lower center of the dome to the bottom edge of the container, and it was determined that it withstood pressures of 99.5 psi before dome reversal occurred. This figure is well above the minimum requirements for this container.

Figure 5:
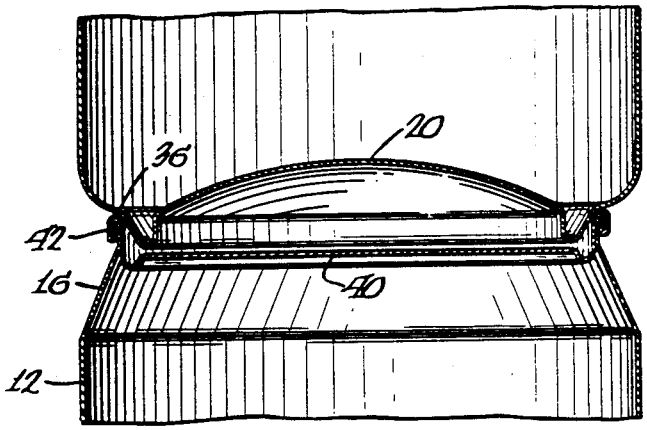

FIG. 5 of the drawings shows the nesting relation between two containers stacked upon each other. It should be noted that the annular arcuate segment 36 has continuous extended contact with the double seam 42 and the U-shaped annular segment 22 is partially wedged into the double seam to prevent tilting of the upper container with respect to the lower container.

While the relative dimensions and their relation have not been fully explored, it is believed that some of the relationships are critical to the overall success in performance of the container. For example, in the specific container described, the diameter D2 was less than 80% of the diameter D1 of the container. The relationship between the diameter of the support surface 34 and the spherical radius R1 of dome 20, along with the vertical annular wall 28, is believed to add strength characteristics. Also, the fact that the joining segment has two arcuate segments 36 and 38 having significantly different radii, with radius R5 being about twice the radius R4, provides excellent internal pressure resistance.

Figure 2:
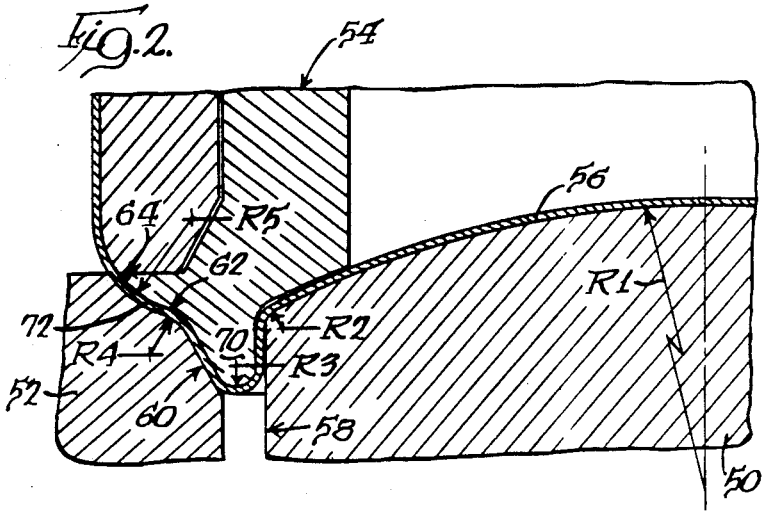
FIG. 2 is an enlarged fragmentary cross-sectional view of the container shown in FIG. 1, along with the tooling for forming the bottom profile.

FIG. 2 of the drawings shows the tooling used for forming the bottom profile of the present invention. The tooling includes a center dome pad 50, an outer annular forming element 52 and a punch 54. The center dome pad 50 has an upper spherical surface 56 having a radius R1 and a peripheral edge having a radius R2, along with a peripheral vertical surface 58. The outer annular forming element 52 has an inclined flat surface 60, a convex annular surface 62 having a radius R4, and a concave annular surface 64 having a radius R5. The punch 54 has a lower nose 70 configured to produce the U-shaped portion 22 and an outer surface 72 conforming to the surfaces 62 and 64. The domer assembly is preferably constructed in accordance with the teachings of the U.S. Pat. No. 4,620,434, issued Nov. 4, 1986, and incorporated herein by reference.

Containers constructed in accordance with the present invention exhibited more than adequate resistance to buckling, internal pressure and column strength. It has also been noted that the stock material thickness could be reduced to 0.0125 inch, and possibly as low as 0.0120 inch, which significantly reduces the raw material cost for these containers.

It should also be noted that the tapered upper end 16 of the container is a constantly-reducing taper from the cylindrical sidewall to the upper flange 18. This constantly-reducing tapered smooth neck is produced in a spin-necking operation and tests have shown that this results in significantly increased crush strength for the container. In fact, these tests show that the upper edge of the neck will actually curl rather than having the tapered portion wrinkle.

While the invention has been particularly shown and described with reference to a preferred embodiment thereof, it will be understood by those skilled in the art that various changes in form and details may be made therein without departing from the spirit and scope of the invention

We claim:

1. A drawn and ironed beer and beverage container including a generally cylindrical side wall having an inwardly-tapered reduced neck at one end with a reduced diameter end connected by a double seam to an open end of said reduced diameter neck, said double seam having an inner generally flat wall that extends generally parallel to the axis of said container with an upper arcuate exposed portion above said inner flat wall; an integral bottom including a first lower convex annular arcuate portion at the end of said cylindrical side wall, a concave annular second arcuate portion integral with a lower end of said first lower convex annular arcuate portion and a generally U-shaped annular third portion, said second arcuate portion adapted to engage said arcuate exposed portion of double seam when stacking a lower portion of a container upon an upper portion of another container, said U-shaped annular third portion having an outer annular flat wall tapered inwardly and an inner substantially vertical flat wall interconnected by a lower arcuate segment that defines a reduced diameter lower annular support for said container; and an inwardly-domed central panel integral with said substantially vertical flat wall.

2. A thin walled drawn and ironed metal beverage container capable of being stacked onto a similar beverage container comprising a generally cylindrical side wall having an inwardly-tapered neck at one open end and an integral bottom wall at an opposite end with an end connected by a double-seam to said open end; said double-seam having an upper arcuate portion and defining an inner diameter which is less than the diameter of said side wall and having a substantially vertical inner wall, said bottom wall having a central inwardly-domed panel with a U-shaped annular segment integral with an outer peripheral edge of said central panel portion, said U-shaped annular segment having a substantially vertical flat inner wall and an upwardly- and outwardly-inclined outer wall interconnected by lower arcuate segment defining an exposed support surface having a diameter less than said side wall and said double-seam inner diameter; and a joining segment having a first arcuate segment defining an exposed convex annular arcuate portion integral with said side wall and a second annular arcuate portion defining an exposed concave surface integral with said outer wall of said U-shaped segment so that, upon stacking of a lower portion of a container onto an upper portion of another container, said concave surface will provide continuous extended contact with said upper arcuate portion of said double-seam and said U-shaped annular segment will be partially wedged into said double-seam to prevent tiling of the upper container with respect to the lower container.

3. A drawn and ironed beverage container as defined in claims 1 or 2, in which said first arcuate portion has a radius which is about twice the radius of said second arcuate portion.

4. A drawn and ironed beverage container as defined in claims 1 or 2, in which said inwardly-tapered neck is generally smooth and continuous between said side wall and said double seam.

5. A drawn and ironed beverage container as defined in claims 1 or 2, in which the radius of said first arcuate portion is about one-tenth the diameter of said lower support and the radius of said second arcuate portion is about one-half the radius of said first arcuate portion.

6. A drawn and ironed beverage container as defined in claims 1 or 2, in which the diameter of said lower annular support is about 2.00 inches and is about 80% of the diameter of said side wall.

* * * * *